US007007941B2

(12) United States Patent
Youn

(10) Patent No.: US 7,007,941 B2
(45) Date of Patent: Mar. 7, 2006

(54) IMAGE FORMING DEVICE TO DISTINGUISH BETWEEN TYPES OF A PRINTING MEDIUM AND DRIVING CONTROL METHOD THEREOF

(75) Inventor: Karp-sik Youn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 107 days.

(21) Appl. No.: 10/281,356

(22) Filed: Oct. 28, 2002

(65) Prior Publication Data

US 2003/0122297 A1 Jul. 3, 2003

(30) Foreign Application Priority Data

Dec. 29, 2001 (KR) ..... 2001-88427

(51) Int. Cl.
*B65H 5/00* (2006.01)

(52) U.S. Cl. ..... 271/10.11; 271/242; 271/258.01

(58) Field of Classification Search ..... 271/10.01, 271/10.09, 10.11, 110, 226, 242, 258.01, 271/265.01; 399/389; 347/104, 106, 153, 347/218, 214

See application file for complete search history.

(56) References Cited

U.S. PATENT DOCUMENTS

| | | | | |
|---|---|---|---|---|
| 4,990,011 | A * | 2/1991 | Underwood et al. | 400/636 |
| 5,282,001 | A * | 1/1994 | Watson | 399/46 |
| 5,692,744 | A * | 12/1997 | Funato | 271/242 |
| 5,765,093 | A * | 6/1998 | Funato | 399/406 |
| 5,904,350 | A * | 5/1999 | Creighton et al. | 271/227 |
| 6,301,452 | B1 * | 10/2001 | Yoshizawa | 399/45 |
| 6,381,422 | B1 * | 4/2002 | Tanaka | 399/45 |
| 6,386,676 | B1 * | 5/2002 | Yang et al. | 347/19 |
| 6,647,241 | B1 * | 11/2003 | Harashima | 399/389 |
| 6,718,145 | B1 * | 4/2004 | Ohta et al. | 399/16 |
| 2002/0168193 | A1 * | 11/2002 | Weaver | 399/45 |
| 2002/0186979 | A1 * | 12/2002 | Ohta et al. | 399/45 |

FOREIGN PATENT DOCUMENTS

| | | |
|---|---|---|
| JP | 04-77649 | 3/1992 |
| JP | 07-309476 | 11/1995 |
| JP | 11-153888 | 6/1999 |

* cited by examiner

*Primary Examiner*—David H. Bollinger
(74) *Attorney, Agent, or Firm*—Staas & Halsey LLP

(57) ABSTRACT

An image forming device capable of distinguishing the type of paper, and a driving controlling method thereof. The an image forming device includes a paper conveyance path disposed in a body of the image forming device, to guide an upside and an underside of the paper which is conveyed from a paper feeding apparatus to an image forming portion; a feeding roller disposed in the paper conveyance path, to convey the paper from the paper feeding apparatus to the image forming portion; and a paper type distinguishing sensor disposed in the paper conveyance path upstream with respect to the feeding roller, to distinguish the type of the paper and output a distinguishing signal. Accordingly, before the paper enters into the image forming portion, the distinguishing signal is output from the paper type distinguishing sensor as the feeding roller is rotated in a reverse direction to align a front end of the paper in parallel with the feeding roller. Therefore, the printing speed of the image forming device is improved.

13 Claims, 4 Drawing Sheets

IMAGE FORMING DEVICE TO DISTINGUISH BETWEEN TYPES OF A PRINTING MEDIUM AND DRIVING CONTROL METHOD THEREOF

CROSS-REFERENCE TO RELATED APPLICATIONS

This application claims the benefit of Korean Application No. 2001-88427, filed Dec. 29, 2001, in the Korean Industrial Property Office, the disclosure of which is incorporated herein by reference.

BACKGROUND OF THE INVENTION

1. Field of the Invention

The present invention relates to an image forming device, and more particularly, to an image forming device to distinguish between types of a printing medium and a driving control method thereof.

2. Description of the Related Art

Generally, an image forming device such as a printer or a multi-function device can select a printing medium in accordance with a type of an image to be printed and can use various printing methods corresponding to characteristics of the selected printing medium. An image forming device such as a color ink-jet printer, which can output a multicolor image such as a photo, by using ink, selects either general paper or coating paper coated with some material to prevent the ink from being smudged. This selection is made in accordance with the type of the image to be printed. The image forming device then outputs the image in a printing method corresponding to the selected paper, thereby improving the printing quality of the output image. A user is required to separately manipulate the image forming device through a terminal connected to the image forming device or an image forming device body.

A disadvantage of the conventional image forming device is that a user must pre-set the type of the printing paper by manipulating the terminal or the image forming device body each time an image is printed. In order to overcome this disadvantage, an image forming device having a paper type distinguishing sensor, which is provided at an image forming portion or a paper feeding apparatus, has been developed. The paper type distinguishing sensor distinguishes the type of the printing paper. Then, the sensor outputs a paper distinguishing signal to a controller of the image forming device or a controller of a terminal to select a printing method according to the distinguished type of the printing paper.

FIG. 1 is a view showing an ink-jet printer 100 having a paper type distinguishing sensor 190 disposed adjacent to a printing nozzle 115 functioning as an image forming portion. As shown in FIG. 1, the paper type distinguishing sensor 190 is disposed between the printing nozzle 115 and a feeding roller 131, and also at a bottom of a printer head 110, to distinguish the type of printing paper 10 before an image is printed on the printing paper 10 by the printing nozzle 115.

The operation of the ink-jet printer 100 of FIG. 1 will now be described. First, a pickup roller 135 is operated to convey the printing paper 10 from a paper feeding apparatus 120 to a paper conveyance path 140. The printing paper 10 conveyed to the paper conveyance path 140 is moved toward the feeding roller 131 by a drive roller 133. The feeding roller 131, the drive roller 133, and the pickup roller 135 are part of a paper conveyance apparatus 130. The paper conveyance path 140 is formed by guide members 160*a*, 160*b* and 160*c*. The printing paper 10 enters into the feeding roller 131, which is detected by a detection unit including a paper entrance detection member 150, which pivots in a rotation shaft 151, and is disposed between the feeding roller 131 and the drive roller 133. When the detection unit outputs a detection signal, the feeding roller 131 is rotated in a reverse direction (opposite to arrow 'a') for a predetermined time. As a result, a front end of the printing paper 10 is aligned to be parallel to the feeding roller 131. Then, the feeding roller 131 is rotated in a normal direction (a) until the printing paper 10 arrives at the paper type distinguishing sensor 190. Then, the feeding roller 131 is stopped. At this point, the paper type distinguishing sensor 190 distinguishes the type of the printing paper 10. Next, the feeding roller 131 is re-rotated in the normal direction (a) to convey the printing paper 10 to a lower portion of the printing nozzle 115. Then, the printing nozzle 115 prints an image on the printing paper 10 corresponding to an input data signal, completing a printing cycle.

In the ink-jet printer 100, however, the feeding roller 131 must be reverse-rotated for the alignment of the front end of the printing paper 10 prior to conveying the printing paper 10 to the printing nozzle 115, and after a predetermined time, the feeding roller 131 is rotated in the normal direction (a) to convey the printing paper 10 to the printing nozzle 115. Before the printing paper 10 arrives at the printing nozzle 115, the feeding roller 131 is stopped for the paper type distinguishing sensor 190 to distinguish the type of the printing paper 10, and then is re-rotated in the normal direction (a). Therefore, there is a problem of decreasing a printing speed of the ink jet printer 100.

In particular, when a paper margin is required to be narrow due to a large image to be printed, the feeding roller 131 is reverse-rotated to retrieve the printing paper 10 from a lower portion of the printer head 110 after distinguishing of the type of the printing paper 10. Then, the feeding roller 131 re-enters the printing paper 10 to the printing nozzle 115 when the printing nozzle 115 is ready to print. Thus, the printing speed of the ink jet printer 100 is further decreased.

SUMMARY OF THE INVENTION

Accordingly, it is an object of the present invention to solve the above problems in the related art.

It is another object of the present invention to provide an image forming device having an improved construction to distinguish the type of paper to improve a printing speed, and a driving control method thereof.

Additional objects and advantages of the invention will be set forth in part in the description which follows and, in part, will be obvious from the description, or may be learned by practice of the invention.

The foregoing and other objects of the invention are achieved by providing an image forming device including a paper feeding apparatus to feed a paper having first and second sides; an image forming portion to form an image on the paper; a paper conveyance path to guide the paper from the paper feeding apparatus to the image forming portion; a feeding roller to convey the paper from the paper feeding apparatus to the image forming portion via the paper conveyance path; and a paper type distinguishing sensor disposed in the paper conveyance path upstream of the feeding roller in a direction of conveyance of the paper, to distinguish a type of the paper and to output a distinguishing signal before the paper enters into the image forming portion, the feeding roller being rotated in a first direction to align a front end of the paper to be parallel with an axis of the feeding roller.

According to an aspect of the present invention, before the paper enters into the image forming portion, the distinguishing signal is output from the paper type distinguishing sensor as the feeding roller is rotated in a reverse direction to align a front end of the paper to be parallel to the feeding roller. Therefore, the paper is not required to be stopped while being conveyed to the image forming portion. Accordingly, the printing speed of the image forming device is improved.

According to another aspect of the present invention, the paper is bent to contact the paper type distinguishing sensor due to the rotation of the feeding roller in the first direction.

The image forming device may also include a drive roller to convey the paper to the feeding roller. The paper type distinguishing sensor is disposed between the feeding roller and the drive roller in the paper conveyance path, and the drive roller rotates in a second direction, opposite the first direction, to convey the paper to the image forming portion, while the feeding roller rotates in the first direction.

The paper conveyance path may have a bent portion at the paper type distinguishing sensor, to guide the paper to be bent, and a space is formed between the paper conveyance path and the paper distinguishing sensor.

According to an aspect of the present invention, a printing side of the paper is bent upwards when the feeding roller is rotated in the first direction.

The paper type distinguishing sensor may be a light detection sensor including a light emitter to emit the light to the paper, and a light receiver to detect an amount of the light emitted from the light emitter and reflected from the paper. Between the feeding roller and the paper type distinguishing sensor is disposed a paper entrance detection unit to detect whether the paper enters into the feeding roller.

The foregoing and other objects of the present invention are also achieved by providing a driving control of an image device, the method including aligning a front of a paper in parallel with an axis of a feeding roller by rotating the feeding roller in a first direction before the paper enters into an image forming portion; rotating the feeding roller in a second direction opposite to the first direction; and distinguishing a type of the paper by generating a distinguishing signal output from a paper type distinguishing sensor in contact with the paper after a standby time, measured with respect to the rotating of the feeding roller in the second direction.

According to an aspect of the present invention, the paper is bent towards the paper type distinguishing sensor as a result of the rotating of the feeding roller in the first direction.

According to an aspect of the present invention, the paper type distinguishing sensor is bent when the standby time has passed.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
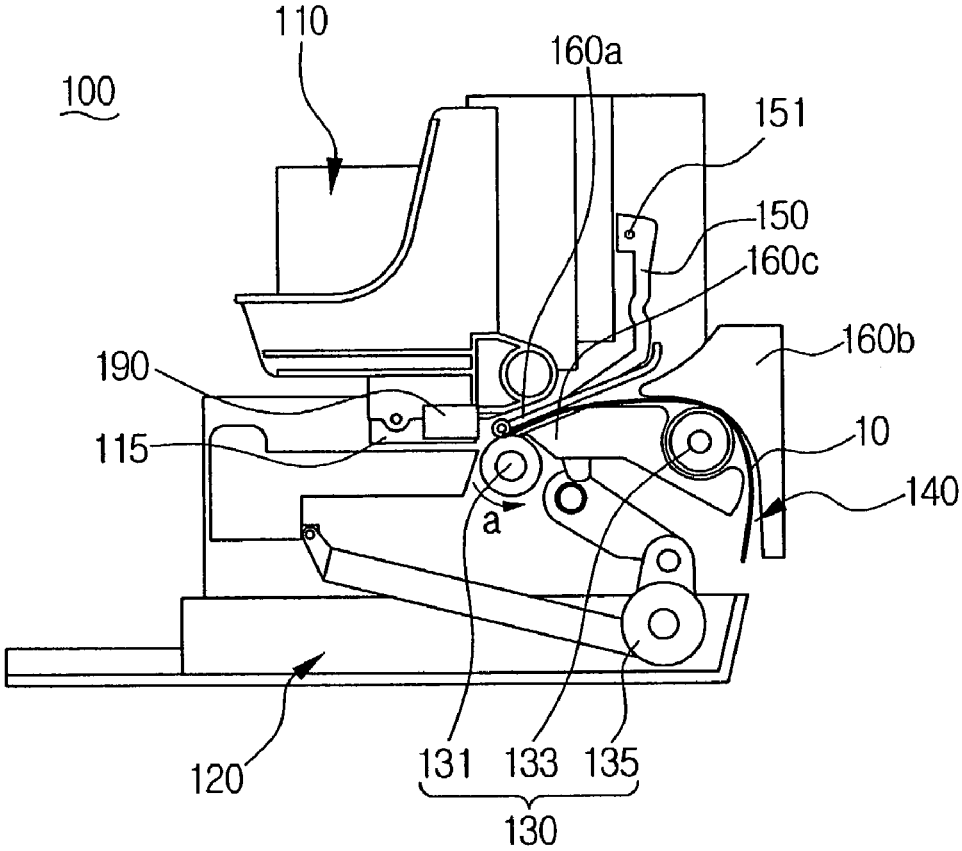
FIG. 1 (PRIOR ART)
FIG. 1 is a schematic side sectional view showing a conventional image forming device.

Reference will now be made in detail to the present preferred embodiments of the present invention, examples of which are illustrated in the accompanying drawings, wherein like reference numerals refer to like elements throughout. It is noted that the components which are identical to those of the conventional image forming device described in FIG. 1, like reference numerals are given, and a detailed description thereof is omitted.

Figure 2:
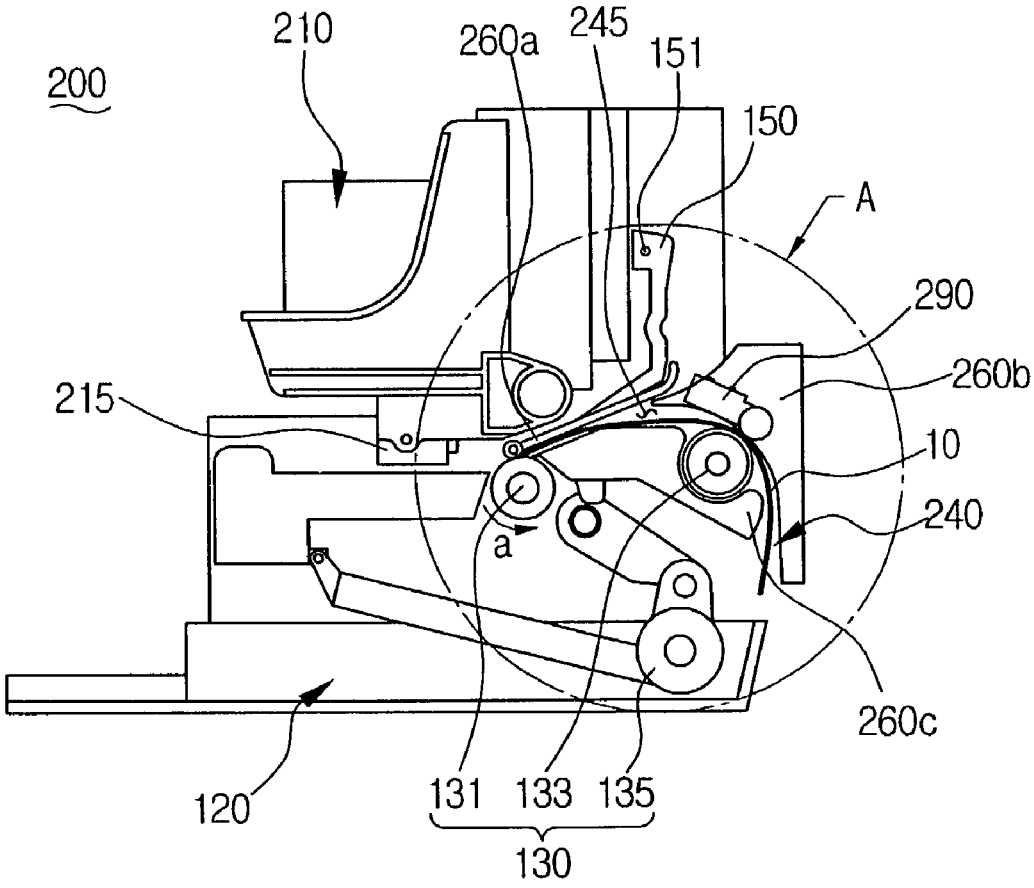
FIG. 2 is a schematic side sectional view showing an image forming device according to an embodiment of the present invention.
Figure 3A:
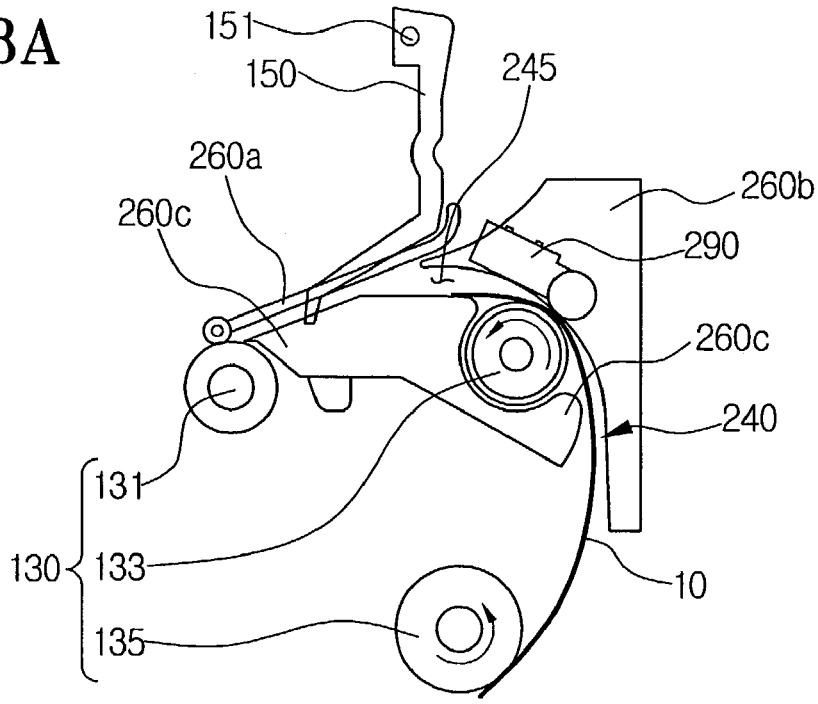
FIGS. 3A through 3D are enlarged side sectional views schematically showing portion "A" of the image forming device of FIG. 2.
Figure 3B:
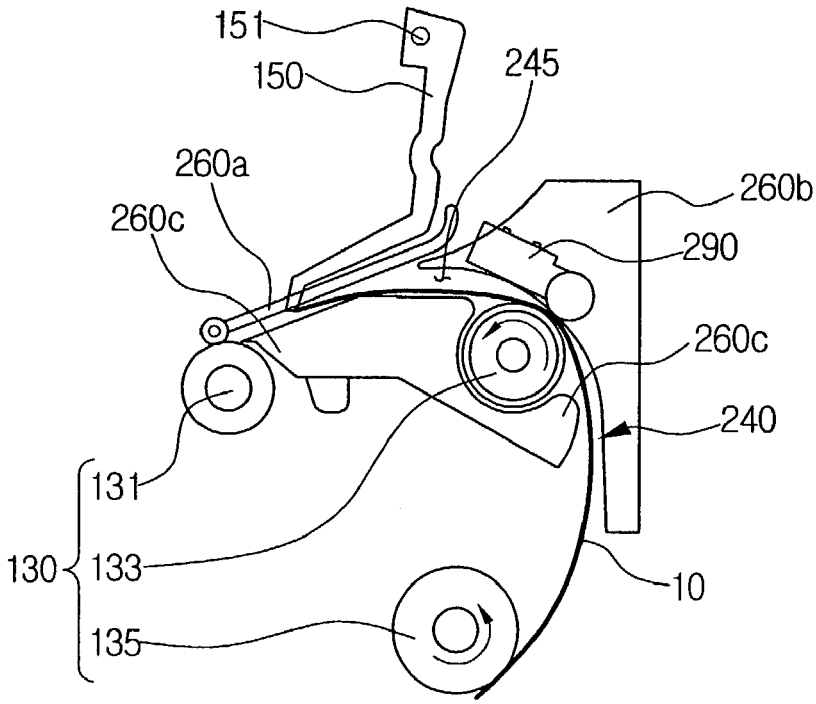
Figure 3C:
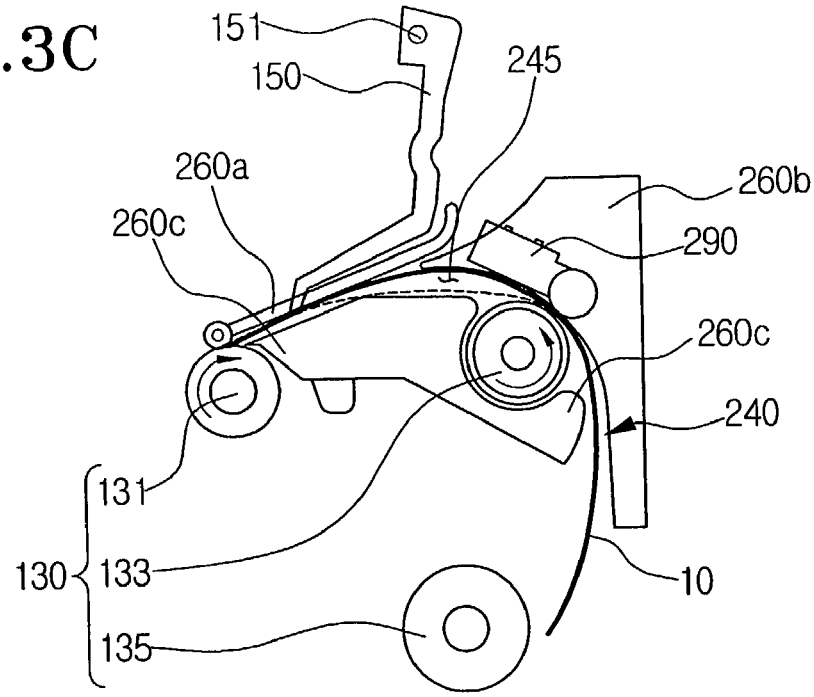
Figure 3D:
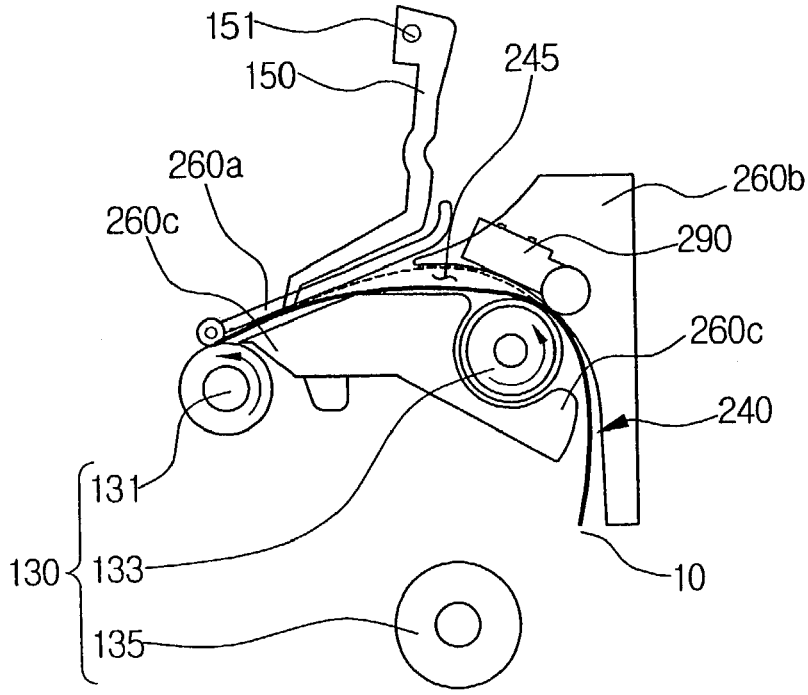

FIGS. 2 through 3D show an ink-jet printer 200 as an example of an image forming device according to an embodiment of the present invention. Hereinafter, the image forming device will be referred to as the ink-jet printer 200. Referring to FIG. 2, the ink-jet printer 200 includes a printer head 210, a paper feeding apparatus 120, a paper conveyance apparatus 130 and a paper type distinguishing sensor 290.

The printer head 210 includes a printing nozzle 215 as an image forming portion, which prints an image on a printing paper 10 fed from the paper feeding apparatus 120 in accordance with an input data signal. The printing nozzle 215 jets reserved ink onto the printing paper 10 conveyed under the printing nozzle 215.

The paper conveyance apparatus 130 includes a paper conveyance path 240, which is formed in the printer 200 by plural guide members 260*a*, 260*b* and 260*c* to support an upper side and a lower side of the printing paper 10 to the printer head 210, a pickup roller 135 disposed in the paper conveyance path 240, a feeding roller 131, a drive roller 133 and a driving unit (not shown) to rotate the rollers 131, 133, 135. The pickup roller 135 picks up the printing paper 10 from the paper feeding apparatus 120, and the feeding roller 131 conveys the printing paper 10 under the printer head 210, and the drive roller 133 conveys the printing paper 10 from the pickup roller 135 to the feeding roller 131. Meanwhile, in this embodiment, the paper conveyance path 240 has a "C" shape having a phase difference of 180° such that the printing paper 10 conveyed from the lower portion of the ink-jet printer 200 is discharged into a center portion after the printing operation.

Meanwhile, the reference numeral 150 indicates a paper entrance detection member to detect whether the printing paper 10 enters into the feeding roller 131. The paper entrance detection member 150 includes a lever that pivots on a rotation shaft 151 with a leading end passing through the guide member 260*a*. The paper entrance detection member 150 is connected to a detection sensor (not shown). When the printing paper 10 enters into the feeding roller 131 and the paper entrance detection member 150 rotates, the detection sensor recognizes that the printing paper 10 enters into the feeding roller 131 and outputs a detection signal. In accordance with the detection signal, the feeding roller 131 rotates in a reverse direction such that a front end of the printing paper 10 is aligned in parallel with the feeding roller 131.

The paper type distinguishing sensor 290 distinguishes the type of the printing paper 10 by recognizing material of the printing paper 10, and outputs a distinguishing signal. In the ink jet printer according to this embodiment, the paper type distinguishing sensor 290 is disposed in the paper conveyance path 240 upstream with respect to the feeding roller 131.

When the ink jet printer 200 operates, the printing paper 10 bends up toward the paper type distinguishing sensor 290 by the feeding roller 131 rotating in the reverse direction, prior to entering into the printer head 210. At this point, the paper type distinguishing sensor 290 partially contacts the printing paper 10, thereby recognizing the material of the printing paper 10 and outputs the distinguishing signal.

In order to perform the above-described function, the paper type distinguishing sensor 290 is disposed between the feeding roller 131 and the drive roller 133, as shown in FIG. 2. In this embodiment, the paper type distinguishing sensor 290 passes through the guide member 260*b* of an upper side of the drive roller 133 and exposes a detection surface toward the paper conveyance path 240. This arrangement is shown for purposes of example, only. The paper type distinguishing sensor 290 can be disposed anywhere if the printing paper 10 contacts the direction surface due to the rotation of the feeding roller 131 in the reverse direction. The paper type distinguishing sensor 290 can use any type of sensor capable of distinguishing the printing paper 10 by contacting the printing paper 10. For example, a light detection sensor may be used. The light detection sensor includes a light emitter to emit the light toward the printing paper 10, and a light receiver to detect an amount of the emitted light reflected from the printing paper 10, and to output the detection signal based on the detected amount of light.

Here, the driver roller 133 rotates in a direction opposite to the rotation direction of the feeding roller 131, i.e. in a direction to convey the printing paper 10 to the printer head 210 such that the printing paper 10 bends more easily. A partial portion of the paper conveyance path 240, where the paper type distinguishing sensor 290 is disposed, is bent up toward the paper type distinguishing sensor 290 to guide the printing paper 10 to be conveyed in a bent state. A space 245 is formed under the paper type distinguishing sensor 290. At this point, a printing side of the printing paper 10, on which an image is printed by the printing nozzle 215, bends up such that the paper type distinguishing sensor 290 accurately distinguishes the type of the printing paper 10 by contacting the printing side.

Referring to FIGS. 3A through 3D, the operation of the ink jet printer 200 will now be described.

When a printing command is input into the ink jet printer 200, the printing paper 10 is conveyed to the feeding roller 131 via the pickup roller 135 and the drive roller 133, as shown in FIG. 3A.

As shown in FIG. 3B, prior to entering into the feeding roller 131, the printing paper 10 contacts the paper entrance detection member 150 such that the detection signal is outputted from the detection sensor (not shown). When the detection signal is outputted from the detection sensor, the feeding roller 131 rotates in the reverse direction, opposite to the normal direction in which the feeding roller 131 rotates to convey the printing paper 10 to the printer head 210. Accordingly, the front end of the printing paper 10 is aligned to be parallel to an axis of the feeding roller 131.

As shown in FIG. 3C, although the feeding roller 131 rotates in the reverse direction, the printing paper 10 is constantly conveyed to the feeding roller 131 due to the drive roller 133. That is, when the feeding roller 131 rotates in the reverse direction, the drive roller 133 constantly rotates in the normal direction (a) to convey the printing paper 10 to the feeding roller 131. Accordingly, the printing paper 10 arriving at the feeding roller 131 does not further advance toward the printing nozzle 215 by the feeding roller 131 rotating in the reverse direction. But, a rear end of the printing paper 10 advances toward the feeding roller 131 by the drive roller 133, thereby bending upwards in the space 245 under the paper type distinguishing sensor 290.

The upward bending of the printing paper 10 results in contact with the detection surface of the paper type distinguishing sensor 290, and accordingly, the paper type distinguishing sensor 290 distinguishes the type of the printing paper 10. That is, the light receiver of the paper type distinguishing sensor 290 detects the amount of the light that is emitted from the light emitter and is then reflected from the printing paper 10, and outputs the detection signal such that a controller (not shown) detects whether the printing side of the printing paper 10 is coated or not, and the kind of the coating material being used. Here, the light receiver outputs the accurate detection signal if the light receiver is spaced from the printing paper 10 by a predetermined distance. Accordingly, the paper type distinguishing sensor 290 is positioned to have a predetermined distance between the detection surface and the light receiver such that the light receiver outputs an accurate detection signal. Thus, the light receiver can output the most accurate detection signal when the printing paper 10 contacts the detection surface. At this point, it takes a predetermined standby time for the printing paper 10 to contact the detection surface, after the feeding roller 131 rotates in the reverse direction. After the predetermined standby time elapses, the paper type distinguishing sensor 290 is automatically turned on to have an optimal distance between the light receiver and the printing paper 10, in order to distinguish the type of the paper 10. The standby time is counted after the paper entrance detection member 150 detects that the printing paper 10 enters into the feeding roller 131, and when the standby time approaches a predetermined reference time, the paper type distinguishing sensor 290 is turned on to output a distinguishing signal. At this time, the printing paper 10 contacts the detection surface of the paper type distinguishing sensor 290.

After the distinguishing of the printing paper 10, as shown in FIG. 3D, the feeding roller 131 rotates in the normal direction (a) to convey the printing paper 10 to the printer head 210. The printing paper 10 is conveyed under the printer head 210 by the feeding roller 131. At this point, since it is not required for the printing paper 10, which is conveyed from the feeding roller 131 to the printer head 210, to be stopped, the printing speed of the printer 200 is improved.

Although the ink jet printer 200 has the paper conveyance path 240 having a "C" shape in this embodiment, the paper conveyance path 240 is not limited to this shape. The paper conveyance path 240 can be employed in an ink-jet printer 200, and other image forming devices, such as a multi-function device or a laser printer, which have various types of paper conveyance paths.

According to the described embodiment of the present invention, the paper type distinguishing sensor 290 is disposed between the feeding roller 131 and the drive roller 133, thereby distinguishing the type of the printing paper 10 with the feeding roller rotating in the reverse direction, to align the front end of the printing paper 10 to be parallel to the feeding roller 131. This is done before the printing paper 10 is conveyed to the image forming device.

Since the alignment of the front end of the printing paper 10 is accomplished simultaneously with the distinguishing of the types of the printing paper 10, the time taken to convey the printing paper 10 to the printer head 210 is reduced, and thus the printing speed of the image forming device is improved.

In the case when the printing margin is small because the image to be printed is large, the printing nozzle 215 is allowed to get ready for the printing operation immediately after the front end of the printing paper 10 is aligned by the feeding roller 131, and the types of the printing paper 10 are distinguished simultaneously. Accordingly, since it is not necessary to retrieve the printing paper 10 entering the printing paper 10 from the printer head 210, the printing speed of the image forming device is not reduced.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An image forming device comprising:

a paper feeding apparatus to feed a paper having first and second sides and a front end;

an image forming portion to form an image on the paper;

a drive roller at a paper conveyance path and being rotated in a first direction to guide the paper from the paper feeding apparatus to the image forming portion;

a feeding roller to convey the paper from the paper feeding apparatus to the image forming portion via the paper conveyance path; and a paper type distinguishing sensor disposed in the paper conveyance path upstream of the feeding roller in a direction of conveyance of the paper, to distinguish a type of the paper, and to output a distinguishing signal before the paper enters into the image forming portion, wherein the feeding roller is rotated in a second direction opposite the first direction while the drive roller is rotated in the first direction and conveying the paper along the conveyance path, the opposing rotation of the drive and feeding rollers aligning the front end of the paper to be parallel with an axis of the feeding roller, wherein the paper type distinguishing sensor distinguishes the type of the paper simultaneously with the aligning of the front end of the paper, and wherein the paper is bent to contact the paper type distinguishing sensor due to the rotation of the feeding roller in the second direction.

2. The image forming device of claim 1, wherein the paper type distinguishing sensor is disposed between the feeding roller and the drive roller in the paper conveyance path.

3. The image forming device of claim 1, wherein the paper conveyance path includes a bent portion at the paper type distinguishing sensor, to guide the paper to be bent, and a space is formed between the paper conveyance path and the paper distinguishing sensor.

4. The image forming device of claim 1, wherein the paper type distinguishing sensor is a light detection sensor including:

a light emitter to emit light towards the paper; and a light receiver to detect an amount of the light emitted from the light emitter and reflected from the paper.

5. The image forming device of claim 1, further comprising a paper entrance detection unit to detect whether the paper is received by the feeding roller, the paper entrance detection unit being between the feeding roller and the paper type distinguishing sensor.

6. A driving control method of an image forming device, comprising:

aligning a front of a paper to be parallel with an axis of a feeding roller by bringing the front of the paper into contact with the feeding roller during a standby time, the standby time initiated by the contact of the front of the paper with the feeding roller, the feeding roller rotating in a first direction of conveyance of the paper to an image forming portion after the standby time; and distinguishing a type of the paper by generating a distinguishing signal when the paper is bent towards a paper type distinguishing sensor by the rotating of a drive roller in the first direction during the standby time, the drive roller being disposed upstream of the feeding roller in the direction of conveyance of the paper, wherein the feeding roller is rotated in a second direction opposite the first direction of conveyance while a drive roller is rotated in the first direction and conveying the paper, the opposing rotation of the drive and feeding rollers aligning the front end of the paper.

7. The driving control method of claim 6, wherein the feeding roller is rotated in a second direction opposite the first direction during the standby time.

8. The driving control method of claim 7, further comprising turning on the paper type distinguishing sensor when the standby time has passed.

9. An image forming device comprising:

an image forming portion to form an image on a paper;

a first roller disposed upstream of the image forming portion in a direction of conveyance of the paper and rotated in a first direction to move the paper to the image forming portion;

a second roller disposed upstream of the first roller in the direction of conveyance of the paper and rotated in the first direction to move the paper to the first roller; and a sensor disposed between the first roller and the second roller to distinguish a type of the paper when the front of the paper is aligned to be parallel with an axis of the first roller, wherein the paper is aligned by rotating the first roller in a second direction opposite the first direction while the second roller is rotated in the first direction, the opposing rotation of the first and second rollers aligning the front end of the paper, wherein the front of the paper is aligned during a standby time, the standby time being initiated by the contact of the front end of the paper with the first roller, and the first roller rotates in the first direction after the standby time, and wherein the sensor distinguishes the type of the paper when the paper is bent towards the sensor, the paper being bent by the opposing rotation of the first and the second rollers during the standby time.

10. The image forming device of claim 9, wherein the sensor detects whether the paper is coated.

11. The image forming device of claim 10, wherein the sensor detects a type of coating.

12. The image forming device of claim 9, wherein the first roller is rotated in a second direction opposite the first direction during the standby time.

13. The image forming device of claim 12, wherein the sensor distinguishes the type of the paper when the sensor is brought into contact with the paper bent by driving the first and the second rollers.

* * * * *

UNITED STATES PATENT AND TRADEMARK OFFICE

CERTIFICATE OF CORRECTION

PATENT NO. : 7,007,941 B2
APPLICATION NO. : 10/281356
DATED : March 7, 2006
INVENTOR(S) : Karp-sik Youn It is certified that error appears in the above-identified patent and that said Letters Patent is hereby corrected as shown below:

On the Front Page, (U.S. Patent Documents) replace “6,647,241 B1” with --6,647,241 B2--, therefor;

(U.S. Patent Documents) replace “6,718,145 B1” with --6,718,145 B2--, therefor;

(Abstract), after “The”, delete “an”.

Signed and Sealed this

Fourth Day of July, 2006

JON W. DUDAS
*Director of the United States Patent and Trademark Office*